US012359680B2

(12) United States Patent
Takemoto

(10) Patent No.: US 12,359,680 B2
(45) Date of Patent: Jul. 15, 2025

(54) BLOWER

(71) Applicant: NIDEC CORPORATION, Kyoto (JP)

(72) Inventor: Shinji Takemoto, Kyoto (JP)

(73) Assignee: NIDEC CORPORATION, Kyoto (JP)

( * ) Notice: Subject to any disclaimer, the term of this patent is extended or adjusted under 35 U.S.C. 154(b) by 0 days.

(21) Appl. No.: 18/921,190

(22) Filed: Oct. 21, 2024

(65) Prior Publication Data

US 2025/0137466 A1 May 1, 2025

(30) Foreign Application Priority Data

Oct. 25, 2023 (JP) ..... 2023-183395

(51) Int. Cl.
*F04D 29/52* (2006.01)
*F04D 19/00* (2006.01)
*F04D 29/66* (2006.01)

(52) U.S. Cl.
CPC ..... *F04D 29/667* (2013.01); *F04D 19/002* (2013.01); *F04D 29/522* (2013.01)

(58) Field of Classification Search
CPC ..... F04D 29/667; F04D 19/002; F04D 29/522
See application file for complete search history.

(56) References Cited

U.S. PATENT DOCUMENTS

| | | | | |
|---|---|---|---|---|
| 11,286,953 | B2 * | 3/2022 | Tokuno | H02K 5/24 |
| 2015/0167682 | A1 * | 6/2015 | Ishihara | F04D 25/0686 417/354 |
| 2023/0023454 | A1 * | 1/2023 | Yamazaki | F04D 19/002 |

* cited by examiner

*Primary Examiner* — Sabbir Hasan
(74) *Attorney, Agent, or Firm* — Keating & Bennett, LLP

(57) ABSTRACT

A blower includes an impeller and a housing. The impeller is rotatable about a central axis. The housing accommodates the impeller. The housing includes a cylindrical wall portion extending along the central axis and covers the impeller from radially outside and including groove portions recessed in a radial direction from an inner circumferential surface of the cylindrical wall portion and arranged in a circumferential direction. A circumferential width of each of the groove portions decreases from an end portion on an upstream side in an air blowing direction of the impeller toward an end portion on a downstream side in the air blowing direction.

8 Claims, 3 Drawing Sheets

BLOWER

CROSS-REFERENCE TO RELATED APPLICATIONS

The present application claims priority under 35 U.S.C. § 119 to Japanese Patent Application No. 2023-183395, filed on Oct. 25, 2023, the entire contents of which are hereby incorporated herein by reference.

1. Field of the Invention

The present disclosure relates to blowers.

2. Background

A conventional blower includes an impeller that is rotatable about a central axis and a housing that accommodates the impeller. The housing has a cylindrical wall portion that extends along the central axis and covers the impeller from radially outside.

However, in the conventional blower, there is a possibility that surging in which the flow of air is disturbed around the rotating impeller occurs. When surging occurs, for example, both the difference in pressure between an exhaust side (downstream side in an air blowing direction) and an intake side (upstream side in the air blowing direction) and the air volume decrease, which may decrease P-Q characteristics.

SUMMARY

An example embodiment of a blower of the present disclosure includes an impeller and a housing. The impeller is rotatable about a central axis. The housing accommodates the impeller. The housing includes a cylindrical wall portion. The cylindrical wall portion extends along the central axis and covers the impeller from radially outside. The cylindrical wall portion includes groove portions. A plurality of groove portions are recessed in the radial direction from an inner circumferential surface of the cylindrical wall portion and arranged in a circumferential direction. A circumferential width of each of the groove portions decreases from an end portion on an upstream side in an air blowing direction of the impeller toward an end portion on a downstream side in the air blowing direction.

The above and other elements, features, steps, characteristics and advantages of the present disclosure will become more apparent from the following detailed description of the example embodiments with reference to the attached drawings.

DETAILED DESCRIPTION

Figure 2:
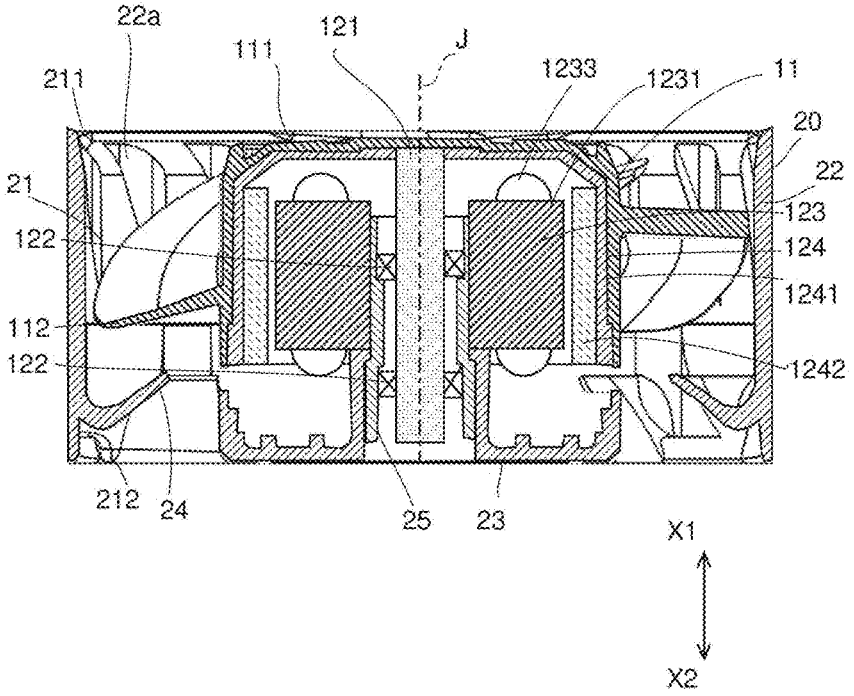
FIG. 2 is a longitudinal sectional view of a blower according to an example embodiment of the present disclosure.

Hereinafter, example embodiments of the present disclosure will be described in detail with reference to the accompanying drawings. In this specification, a direction in which a central axis of a blower extends is simply referred to as an "axial direction", a direction perpendicular to the central axis of the blower as the center is simply referred to as a "radial direction", and a direction extending along a circular arc about the central axis of the blower is simply referred to as a "circumferential direction". Additionally, for the sake of convenience in description, in this specification, the axial direction is assumed to be a vertical direction, and the shape of parts and positional relationships among the parts are described on the assumption that the vertical direction in FIG. 2 is the vertical direction of the blower. An "upper side" of the blower is an "intake side" and a "lower side" of the blower is an "exhaust side". It is to be noted that this definition of the vertical direction does: not restrict the orientation and positional relationship of the blower when in use. Further, in this specification, a section parallel to the axial direction is referred to as a "longitudinal section". Furthermore, the term "parallel" used in this specification does not mean parallel in a strict sense, but includes substantially parallel.

Figure 1:
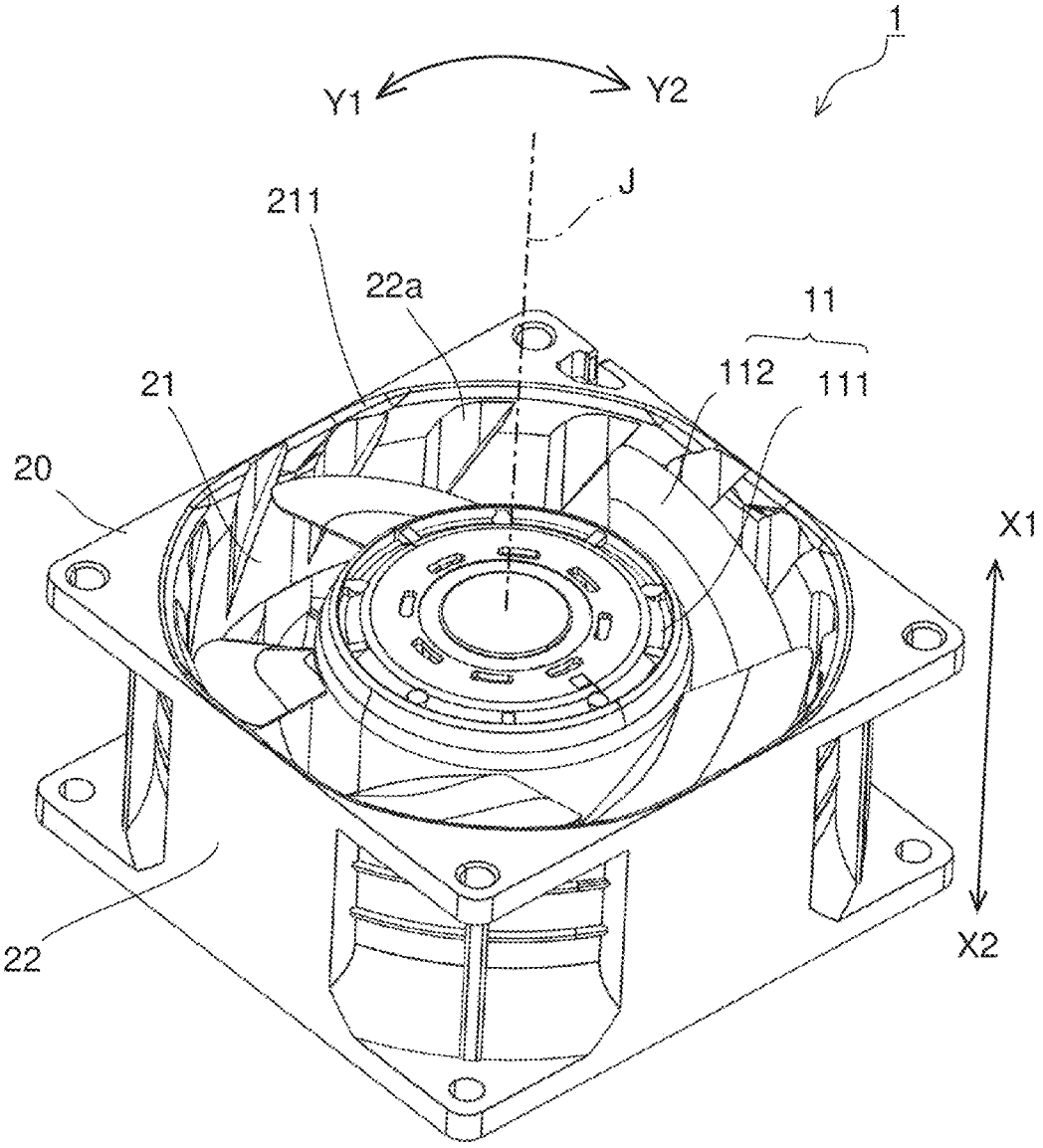
FIG. 1 is an overall perspective view of a blower according to an example embodiment of the present disclosure.

FIG. 1 is an overall perspective view of an example of a blower 1 according to an example embodiment of the present disclosure, and FIG. 2 is a longitudinal sectional view of the blower 1.

The blower 1 includes an impeller 11, a motor 12, and a housing 20.

The housing 20 has an air blowing path 21 therein. The air blowing path 21 extends along a central axis J inside the housing 20. The air blowing path 21 has an air inlet 211 at its upper end and an air outlet 212 at its lower end.

The housing 20 is a resin-molded article (mold-molded article), and accommodates the impeller 11, the motor 12, and a circuit board (not illustrated) therein. The housing 20 includes a cylindrical wall portion 22, a base portion 23, stator blade portions 24, and a bearing holder 25.

The cylindrical wall portion 22 extends along the central axis J and covers the impeller 11 from radially outside. The cylindrical wall portion 22 has a cylindrical shape that extends vertically in the axial direction. The air blowing path 21 is disposed radially inside the cylindrical wall portion 22. The air inlet 211 is disposed at an axially upper end of the cylindrical wall portion 22. The air outlet 212 is disposed at an axially lower end of the cylindrical wall portion 22.

The cylindrical wall portion 22 has groove portions 22*a*. A plurality of groove portions 22*a* are recessed in the radial direction from an inner circumferential surface of the cylindrical wall portion 22 and arranged in its circumferential direction (see FIG. 3). In the present example embodiment, the groove portions 22*a* are provided at 16 locations and arranged at equal intervals in the circumferential direction. The shape of each groove portion 22*a* will be described in detail later.

The base portion 23 is disposed axially below the motor 12, and the motor 12 is fixed thereon. The base portion 23 has a disk shape extending in the radial direction around the central axis J.

The stator blade portions 24 extend radially outward from a radially outer surface of the base portion 23, and connect the base portion 23 and the cylindrical wall portion 22. A plurality of stator blade portions 24 are arranged in the circumferential direction. In other words, the plurality of stator blade portions 24 extend radially inward from a downstream end portion of the cylindrical wall portion 22 in the air blowing direction and are arranged in the circumferential direction. The air flowing through the air blowing path 21 is rectified and blown outside the housing 20 when passing through between the adjacent stator blade portions 24. In the present example embodiment, the stator blade portions 24 are provided at eight locations and arranged at equal intervals in the circumferential direction.

The bearing holder 25 is, for example, a metal member such as brass, and is integrally molded with the base portion 23. The bearing holder 25 protrudes axially upward from an upper surface of the base portion 23 and has a cylindrical shape with the central axis J as the center. The bearing holder 25 holds bearings 122 to be described later inside and constitutes a part of the motor 12. Note that, instead of molding the bearing holder 25 as a separate member from the base portion 23, the bearing holder may be molded integrally with the base portion 23 by the same resin member.

The impeller 11 is disposed radially inside the cylindrical wall portion 22 and axially above and radially outside the motor 12. The impeller 11 is a resin-molded article (mold-molded article), and is rotated about the central axis J by the motor 12.

The impeller 11 includes an impeller cup 111 and blade portions 112. The impeller cup 111 is fixed to the motor 12. The impeller cup 111 is a substantially cylindrical member having a lid on the axially upper side. The plurality of blade portions 112 are arranged in the circumferential direction on an outer surface of the impeller cup 111.

The motor 12 is fixed to the base portion 23 and accommodated in the housing 20. The motor 12 rotates the impeller 11 about the central axis J (Y1 direction). The motor 12 includes a shaft 121, the bearings 122, the bearing holder 25, a stator 123, and a rotor 124.

The shaft 121 is disposed along the central axis J. The shaft 121 is, for example, a columnar member which is made of metal such as stainless steel, and extends in the axial direction. The shaft 121 is supported by the bearings 122 so as to be rotatable about the central axis J.

The bearings 122 are arranged in at least an upper and lower pair in the axial direction. The bearings 122 are held inside the bearing holder 25. The bearings 122 are each configured by, for example, a ball bearing, but may be configured by a sleeve bearing or the like. The upper and lower pair of bearings 122 in the axial direction supports the shaft 121 so that the shaft is rotatable about the central axis J relative to the housing 20.

The stator 123 is fixed to an outer circumferential surface of the bearing holder 25. The stator 123 includes a stator core 1231, an insulator 1232 (not illustrated), and a coil 1233.

The stator core 1231 is formed by vertically stacking electromagnetic steel plates such as silicon steel plates. The insulator 1232 (not illustrated) is made of an insulating resin. The insulator 1232 (not illustrated) is provided so as to surround an outer surface of the stator core 1231. The coil 1233 is formed of a conductive wire wound around the stator core 1231 via the insulator 1232.

The rotor 124 is disposed axially above and radially outside the stator 123. The rotor 124 rotates about the central axis J relative to the stator 123. The rotor 124 includes a rotor yoke 1241 and a magnet 1242.

The rotor yoke 1241 is a substantially cylindrical member that is made of a magnetic material and has a lid on the axially upper side. The rotor yoke 1241 is fixed to the shaft 121. The magnet 1242 has a cylindrical shape and is fixed to an inner circumferential surface of the rotor yoke 1241. The magnet 1242 is disposed radially outside the stator 123.

The circuit board (not illustrated) is disposed, for example, axially below the impeller 11 and axially above the base portion 23. The circuit board has, for example, a disk shape that extends in the radial direction with the central axis J as the center. The circuit board is electrically connected to a coil lead wire of the coil 1233. An electronic circuit for supplying a drive current to the coil 1233 is mounted on the circuit board.

When a drive current is supplied to the coil 1233 of the motor 12 via the circuit board in the blower 1 configured as described above, magnetic flux in the radial direction is generated in the stator core 1231. A magnetic field generated by the magnetic flux of the stator core 1231 and a magnetic field generated by the magnet 1242 act to generate torque in the circumferential direction of the rotor 124. Due to this torque, the rotor 124 and the impeller 11 rotate counter-clockwise (Y1 direction) about the central axis J. When the impeller 11 rotates, the plurality of blade portions 112 generate an airflow. In other words, the blower 1 can blow air by generating an airflow with the upper side as an intake side (upstream side in an air blowing direction) X1 and the lower side as an exhaust side (downstream side in the air blowing direction) X2.

Figure 3:
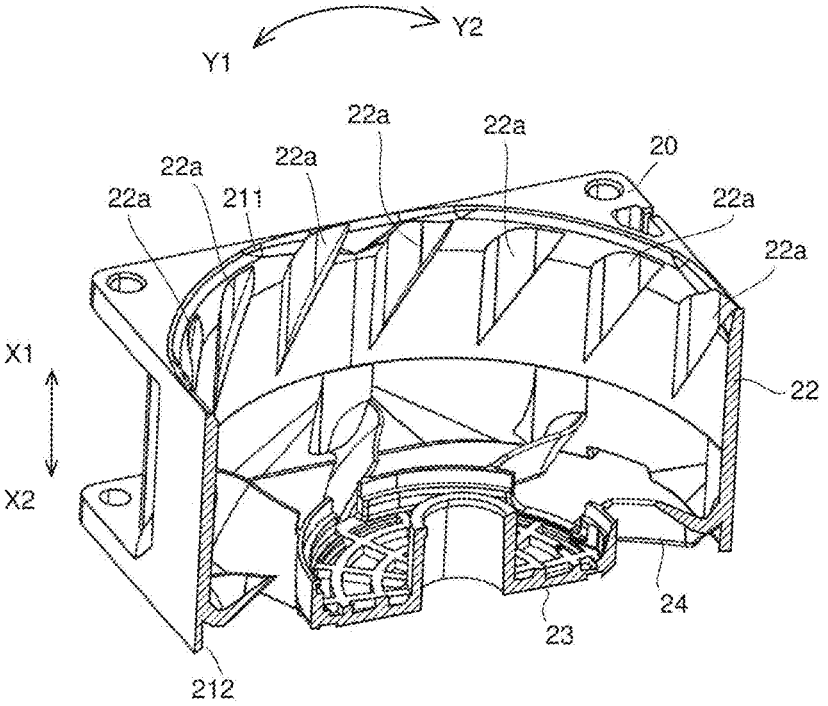
FIG. 3 is a longitudinal sectional perspective view of a housing of a blower according to an example embodiment of the present disclosure.
Figure 4:
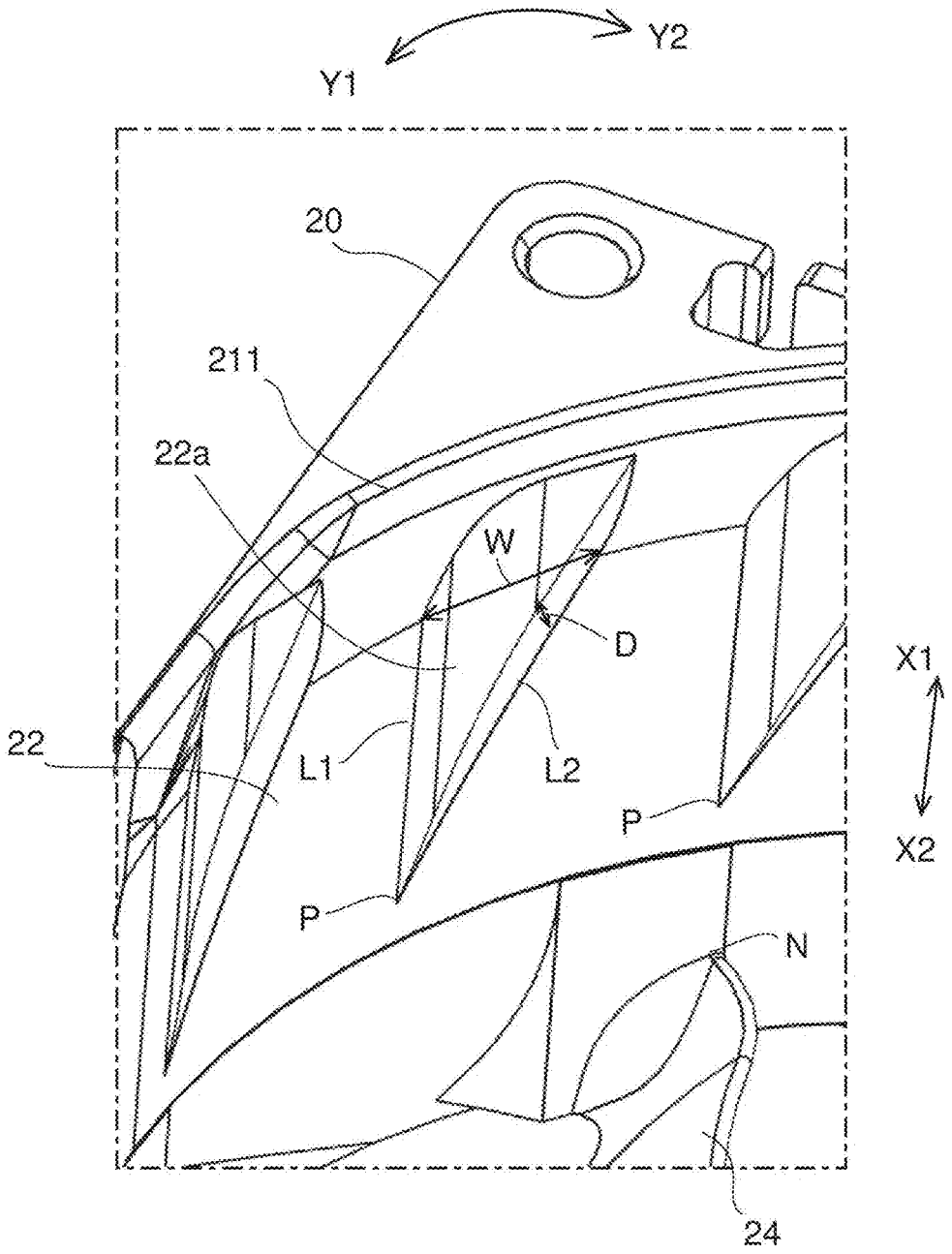
FIG. 4 is an enlarged perspective view illustrating a part of the housing of a blower according to an example embodiment of the present disclosure.

FIG. 3 is a longitudinal sectional perspective view of the housing 20, and FIG. 4 is an enlarged perspective view illustrating the groove portion **22*a* of the housing 20**.

In the present example embodiment, the groove portion **22*a* is formed in a substantially triangular shape when the inner circumferential surface of the cylindrical wall portion 22 is developed in the circumferential direction. Specifically, a wall surface L1 of the groove portion 22*a* on a front side Y1 in a rotation direction of the impeller 11 extends in the axial direction (X1-X2 direction). In addition, a wall surface L2 of the groove portion 22*a* on a rear side Y2 in the rotation direction of the impeller 11 is inclined to the front side Y1 in the rotation direction toward the downstream side X2 in the air blowing direction. Further, the wall surface L1 on the front side Y1 in the rotation direction of the impeller 11 and the wall surface L2** on the rear side Y2 in the rotation direction thereof intersect at an end P on the downstream side X2 in the air blowing direction.

As a result, a circumferential width W of the groove portion **22*a* decreases from an end portion on the upstream side X1 in the air blowing direction of the impeller 11 toward an end portion on the downstream side X2 in the air blowing direction thereof. Accordingly, the groove portion 22*a* is formed in such a way that the circumferential width W gradually narrows over the entire length in the air blowing direction (X1-X2). As a result, an airflow smoothly flows along the groove portion 22*a* toward the downstream side X2 in the air blowing direction on the inner circumferential surface of the cylindrical wall portion 22. This makes it possible to improve P-Q characteristics while suppressing surging. In addition, since the airflow smoothly flows along the inner circumferential surface of the cylindrical wall portion 22**, quietness is also improved.

Meanwhile, an airflow flowing along the groove portion **22*a* smoothly flows toward the downstream side X2 in the air blowing direction while rotating toward the front side Y1 in the rotation direction of the impeller 11 along the wall surface L2 of the inclined groove portion 22*a***. This makes it possible to further suppress surging.

Meanwhile, an airflow flowing along the groove portion **22*a*** smoothly flows from the end P toward the downstream side X2 in the air blowing direction. This makes it possible to further suppress surging.

Meanwhile, a radial depth D of the groove portion **22*a* decreases toward the downstream side X2 in the air blowing direction. As a result, an airflow flowing along the groove portion 22***a* smoothly flows toward the downstream side X2 in the air blowing direction. This makes it possible to further suppress surging.

Meanwhile, the radial depth D of the groove portion 22*a* decreases toward the front side Y1 in the rotation direction of the impeller 11. As a result, an airflow flowing along the groove portion 22*a* smoothly flows toward the front side Y1 in the rotation direction of the impeller 11. This makes it possible to further suppress surging.

Meanwhile, the end of the groove portion 22*a* on the upstream side X1 in the air blowing direction is located closer to the upstream side X1 in the air blowing direction than the end of the blade portion 112 on the upstream side X1 in the air blowing direction (see FIGS. 1 and 2). As a result, an airflow smoothly flows into the housing 20 along the groove portion 22*a*. Meanwhile, the end P of the groove portion 22*a* on the downstream side X2 in the air blowing direction is located closer to the upstream side X1 in the air blowing direction than the end of the blade portion 112 on the downstream side X2 in the air blowing direction. As a result, an airflow flows along the cylindrical wall portion 22, where no groove portion 22*a* is formed, on the downstream side X2 in the air blowing direction further than the blade portion 112. This makes it possible to reduce noise generated in the vicinity of the end portion on the downstream side X2 in the air blowing direction of the housing 20, and thus further improve quietness.

Meanwhile, the groove portion 22*a* is disposed so as to correspond to the stator blade portion 24. Specifically, the end P of the groove portion 22*a* on the downstream side X2 in the air blowing direction is located closer to the upstream side X1 in the air blowing direction than the end of the stator blade portion 24 on the upstream side X1 in the air blowing direction (see FIG. 5). In addition, in the present example embodiment, in the groove portion 22*a*, the end P of the groove portion 22*a* on the downstream side X2 in the air blowing direction axially faces an end portion N on the rear side Y2 in the rotation direction of the impeller 11 at a root portion on the cylindrical wall portion 22 side of the stator blade portion 24. As a result, an airflow flowing along the groove portion 22*a* smoothly flows toward the stator blade portion 24. This makes it possible to further suppress surging.

The above example embodiment is merely an example of the present disclosure. The configuration of the example embodiment may be appropriately changed without departing from the technical idea of the present disclosure. In addition, the example embodiment may be implemented in combination within a feasible range. For example, in the present example embodiment, 16 groove portions 22*a* are provided, but 17 or more groove portions may be provided. Also, the groove portions 22*a* may be provided at 15 or less locations.

As described above, a blower (1) according to an example embodiment of the present disclosure includes an impeller (11) that is rotatable about a central axis (J), and a housing (20) that accommodates the impeller, in which the housing includes a cylindrical wall portion (22) that extends along the central axis and covers the impeller from radially outside, the impeller includes a plurality of blade portions (112) that are arranged in a circumferential direction, the cylindrical wall portion includes a plurality of groove portions (22*a*) that are recessed in a radial direction from an inner circumferential surface of the cylindrical wall portion and arranged in the circumferential direction, and a circumferential width (W) of each of the groove portions decreases from an end portion on an upstream side (X1) in an air blowing direction of the impeller toward an end portion on a downstream side (X2) in the air blowing direction (first configuration).

In the first configuration described above, a radial depth (D) of the groove portion decreases toward the downstream side in the air blowing direction (second configuration).

In the first or second configuration described above, the radial depth (D) of the groove portion decreases toward a front side in a rotation direction of the impeller (third configuration).

In any one of the first to third configurations described above, an end surface (L1) of the groove portion on the front side (Y1) in the rotation direction of the impeller extends in an axial direction, and an end surface (L2) of the groove portion on a rear side (Y2) in the rotation direction of the impeller is inclined to the front side in the rotation direction toward the downstream side in the air blowing direction (fourth configuration).

In any one of the first to fourth configurations described above, the end surface of the groove portion on the front side in the rotation direction and the end surface of the groove portion on the rear side in the rotation direction intersect at an end (P) on the downstream side in the air blowing direction (fifth configuration).

In any one of the first to fifth configurations described above, the impeller includes the plurality of blade portions (112) arranged in the circumferential direction, and an end of the groove portion on the upstream side in the air blowing direction is located closer to the upstream side in the air blowing direction than an end of each of the blade portions on the upstream side in the air blowing direction (sixth configuration).

In any one of the first to sixth configurations described above, an end of the groove portion on the downstream side in the air blowing direction is located closer to the upstream side in the air blowing direction than an end of the blade portion on the downstream side the in blowing air direction (seventh configuration).

In any one of the first to seventh configurations described above, the housing includes a plurality of stator blade portions (24) each extending radially inward from a downstream end portion of the cylindrical wall portion in the air blowing direction and arranged in the circumferential direction, and the groove portion is disposed so as to correspond to the stator blade portion (seventh configuration).

Example embodiments of the present disclosure are applicable to, for example, a blower for cooling a server.

Features of the above-described example embodiments and the modifications thereof may be combined appropriately as long as no conflict arises.

While example embodiments of the present disclosure have been described above, it is to be understood that variations and modifications will be apparent to those skilled in the art without departing from the scope and spirit of the present disclosure. The scope of the present disclosure, therefore, is to be determined solely by the following claims.

What is claimed is:

1. A blower comprising:

an impeller that is rotatable about a central axis; and a housing that accommodates the impeller; wherein the housing includes a cylindrical wall portion that extends along the central axis and covers the impeller from radially outside;

the cylindrical wall portion includes groove portions that are recessed in a radial direction from an inner circumferential surface and arranged in a circumferential direction; and a circumferential width of each of the groove portions decreases from an end portion on an upstream side in an air blowing direction of the impeller toward an end portion on a downstream side in the air blowing direction.

2. The blower according to claim 1, wherein a radial depth of each of the groove portions decreases toward the downstream side in the air blowing direction.

3. The blower according to claim 1, wherein a radial depth of each of the groove portions decreases toward a front side in a rotation direction of the impeller.

4. The blower according to claim 1, wherein a wall surface of each of the groove portions on a front side in a rotation direction of the impeller extends in an axial direction, and a wall surface of each of the groove portions on a rear side in the rotation direction of the impeller is inclined to the front side in the rotation direction toward the downstream side in the air blowing direction.

5. The blower according to claim 4, wherein the wall surface of each of the groove portions on the front side in the rotation direction and the wall surface of each of the groove portions on the rear side in the rotation direction intersect at an end on the downstream side in the air blowing direction.

6. The blower according to claim 1, wherein the impeller includes blade portions arranged in the circumferential direction; and an end of each of the groove portions on the upstream side in the air blowing direction is located closer to the upstream side in the air blowing direction than an end of each of the blade portions on the upstream side in the air blowing direction.

7. The blower according to claim 6, wherein an end of each of the groove portions on the downstream side in the air blowing direction is located closer to the upstream side in the air blowing direction than an end of the blade portions on the downstream side in the air blowing direction.

8. The blower according to claim 1, wherein the housing includes stator blade portions each extending radially inward from a downstream end portion of the cylindrical wall portion in the air blowing direction and arranged in the circumferential direction; and the groove portions are located to correspond to the stator blade portions.

* * * * *